US006148704A

United States Patent [19]

Lewis

[11] Patent Number: 6,148,704

[45] Date of Patent: Nov. 21, 2000

[54] VEGETABLE CUTTING DEVICE

[76] Inventor: Catherine Lewis, 3600 Radial Ave., Albany, Ga. 31705

[21] Appl. No.: 09/160,276

[22] Filed: Sep. 24, 1998

[51] Int. Cl.[7] ..... B26D 1/553

[52] U.S. Cl. ..... 83/167; 83/932; 83/605

[58] Field of Search ..... 83/167, 579, 607, 83/608, 733, 932, 605; 220/266, 263, 367.1, 471; 100/37; 99/537

[56] References Cited

U.S. PATENT DOCUMENTS

| | | | |
|---|---|---|---|
| 29,766 | 8/1860 | Chichester | 83/608 |
| 158,827 | 1/1875 | Brown | 83/167 |
| 486,917 | 11/1892 | Walker | 83/599 |
| 741,960 | 10/1903 | Friis | 83/167 |
| 769,999 | 9/1904 | Foran | 83/607 |
| 1,043,472 | 11/1912 | Shaw | 83/599 |
| 1,531,314 | 3/1925 | Simberg et al. | 83/599 |
| 1,582,103 | 4/1926 | Vitullo | 83/599 |
| 1,746,744 | 2/1930 | Siegle | 833/527 |
| 1,955,458 | 4/1934 | Hardy | 83/167 |
| 1,979,199 | 10/1934 | Haynes | 83/608 |
| 2,465,266 | 3/1949 | Rieder | 83/167 |
| 3,741,104 | 6/1973 | Kanneliesser | 100/37 |
| 3,942,399 | 3/1976 | Giangiulio | 83/167 |
| 3,979,982 | 9/1976 | Cole | 83/607 |
| 3,995,521 | 12/1976 | Raphael | 83/733 |
| 4,027,566 | 6/1977 | Harrill | 83/733 |
| 4,137,807 | 2/1979 | Schaumberg | 83/599 |
| 4,145,941 | 3/1979 | Davis | 83/167 |
| 4,212,431 | 7/1980 | Doyel | 83/167 |
| 4,220,252 | 9/1980 | Beall et al. | 220/266 |
| 4,656,817 | 4/1987 | Keady et al. | 83/167 |
| 5,044,245 | 9/1991 | Molleker et al. | 83/733 |
| 5,109,625 | 5/1992 | Skrede | 220/263 |
| 5,207,137 | 5/1993 | Baril | 83/167 |
| 5,445,332 | 8/1995 | Shimizu et al. | 83/167 |
| 5,533,642 | 7/1996 | Lafond et al. | 220/367.1 |
| 5,601,715 | 2/1997 | Middleton et al. | 220/471 |
| 5,745,999 | 5/1998 | Zirkiev | 83/167 |
| 5,765,472 | 6/1998 | Kim | 83/167 |

*Primary Examiner*—Rinaldi I. Rada
*Assistant Examiner*—Kim Ngoc Tran
*Attorney, Agent, or Firm*—Douglas E. Mackanzie & Associates P.A.

[57] ABSTRACT

A vegetable cutting device incorporating a turntable for placement thereon of the vegetables to be cut and chopped. The device includes a cutting board having a cutting board top surface and an aperture formed in a center thereof, a turntable having a shaft integrally formed perpendicularly to a center of a bottom surface, the shaft being receivable within the aperture, a cutting tool mounted upon the cutting board top surface and a basket having a perforated bottom shelf, the basket being hingedly attachable to the cutting board. In a stored position, the cutting board rests upon a top surface of the basket and the turntable and cutting tool are receivable within the basket.

5 Claims, 4 Drawing Sheets

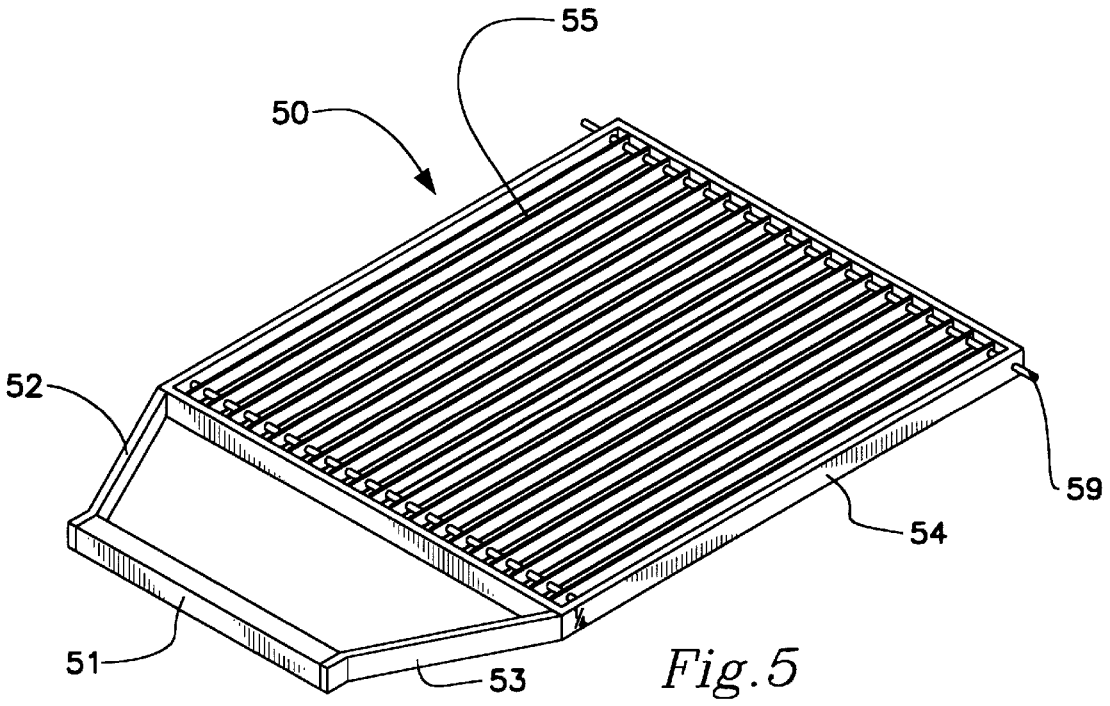
Fig.5
Fig.6
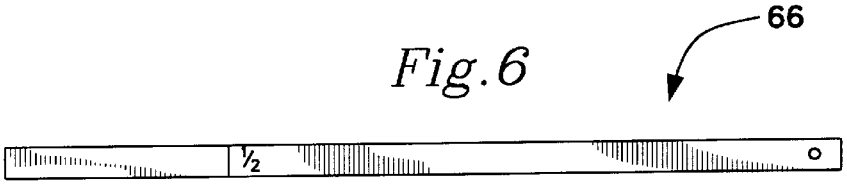
Fig.7
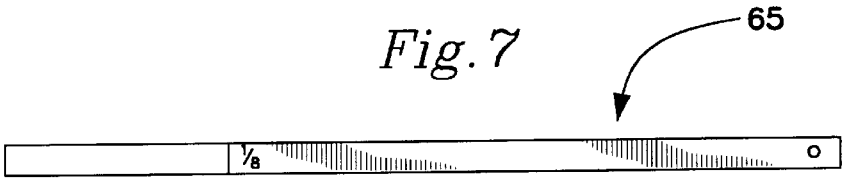

VEGETABLE CUTTING DEVICE

BACKGROUND OF THE INVENTION

1. Field of the Invention

The present invention relates to apparatus for cutting and chopping vegetables and more particularly pertains to a new vegetable cutting device incorporating a turntable for placement thereon of the vegetables to be cut and chopped. Additionally, a basket is provided for facilitating the washing and draining of the cut and chopped vegetables.

2. Description of the Prior Art

The use of apparatus for cutting and chopping vegetables is known in the prior art. More specifically, apparatus for cutting and chopping vegetables heretofore devised and utilized are known to consist basically of familiar, expected and obvious structural configurations, notwithstanding the myriad of designs encompassed by the crowded prior art which have been developed for the fulfillment of countless objectives and requirements.

Known prior art apparatus for cutting and chopping vegetables include U.S. Pat. Nos. 5,363,7565; 5,216,031; U.S. Pat. Nos. Des. 335,609; Des. 268, 562; U.S. Pat. Nos. 5,148,731 and 4,602,543.

While these devices fulfill their respective, particular objectives and requirements, the aforementioned patents do not disclose a new vegetable cutting device. The inventive device includes a cutting board having a cutting board top surface and an aperture formed in a center thereof, a turntable having a shaft integrally formed perpendicularly to a center of a bottom surface thereof, the shaft being receivable within the aperture, a means for cutting mounted upon the cutting board top surface, and a basket having a plurality of perforations formed on a bottom shelf thereof and being hingedly attachable to the cutting board.

In these respects, the vegetable cutting device according to the present invention substantially departs from the conventional concepts and designs of the prior art, and in so doing provides an apparatus incorporating a turntable for placement thereon of the vegetables to be cut and chopped.

SUMMARY OF THE INVENTION

In view of the foregoing disadvantages inherent in the known types of apparatus for cutting and chopping vegetables now present in the prior art, the present invention provides a new vegetable cutting device construction incorporating a turntable for placement thereon of the vegetables to be cut and chopped.

The general purpose of the present invention, which will be described subsequently in greater detail, is to provide a new vegetable cutting device apparatus and method which has many of the advantages of the apparatus for cutting and chopping vegetables mentioned heretofore and many novel features that result in a new vegetable cutting device which is not anticipated, rendered obvious, suggested, or even implied by any of the prior art apparatus for cutting and chopping vegetables, either alone or in any combination thereof.

To attain this, the present invention generally comprises a cutting board having a cutting board top surface and an aperture formed in a center thereof, a turntable having a shaft integrally formed perpendicularly to a center of a bottom surface, the shaft being receivable within the aperture, a means for cutting mounted upon the cutting board top surface, and a basket having a plurality of perforations formed on a bottom shelf thereof and hingedly attachable to the cutting board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vegetable cutting device apparatus and method which has many of the advantages of the apparatus for cutting and chopping vegetables mentioned heretofore and many novel features that result in a new vegetable cutting device which is not anticipated, rendered obvious, suggested, or even implied by any of the prior art apparatus for cutting and chopping vegetables, either alone or in any combination thereof.

It is another object of the present invention to provide a new vegetable cutting device which may be easily and efficiently manufactured and marketed.

It is a further object of the present invention to provide a new vegetable cutting device which is of a durable and reliable construction.

An even further object of the present invention is to provide a new vegetable cutting device which is susceptible of a low cost of manufacture with regard to both materials and labor, and which accordingly is then susceptible of low prices of sale to the consuming public, thereby making such vegetable cutting device economically available to the buying public.

Still yet another object of the present invention is to provide a new vegetable cutting device which provides in the apparatuses and methods of the prior art some of the advantages thereof, while simultaneously overcoming some of the disadvantages normally associated therewith.

Still another object of the present invention is to provide a new vegetable cutting device incorporating a turntable for placement thereon of the vegetables to be cut and chopped.

Yet another object of the present invention is to provide a new vegetable cutting device which includes a cutting board having a cutting board top surface and an aperture formed in a center thereof, a turntable having a shaft integrally formed perpendicularly to a center of a bottom surface thereof, the shaft being receivable within the aperture, a means for cutting mounted upon the cutting board top surface, and a basket having a plurality of perforations formed on a bottom shelf thereof and hingedly attachable to the cutting board.

Still yet another object of the present invention is to provide a new vegetable cutting device that allows for the easy washing and cleaning of the cut and chopped vegetables.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the cutting tool of the present invention.

FIG. 6 is a side elevation view of an alternative embodiment of the cutting tool.

FIG. 7 is a side elevation view of yet another embodiment of the cutting tool.

DESCRIPTION OF THE PREFERRED EMBODIMENT

Figure 1:
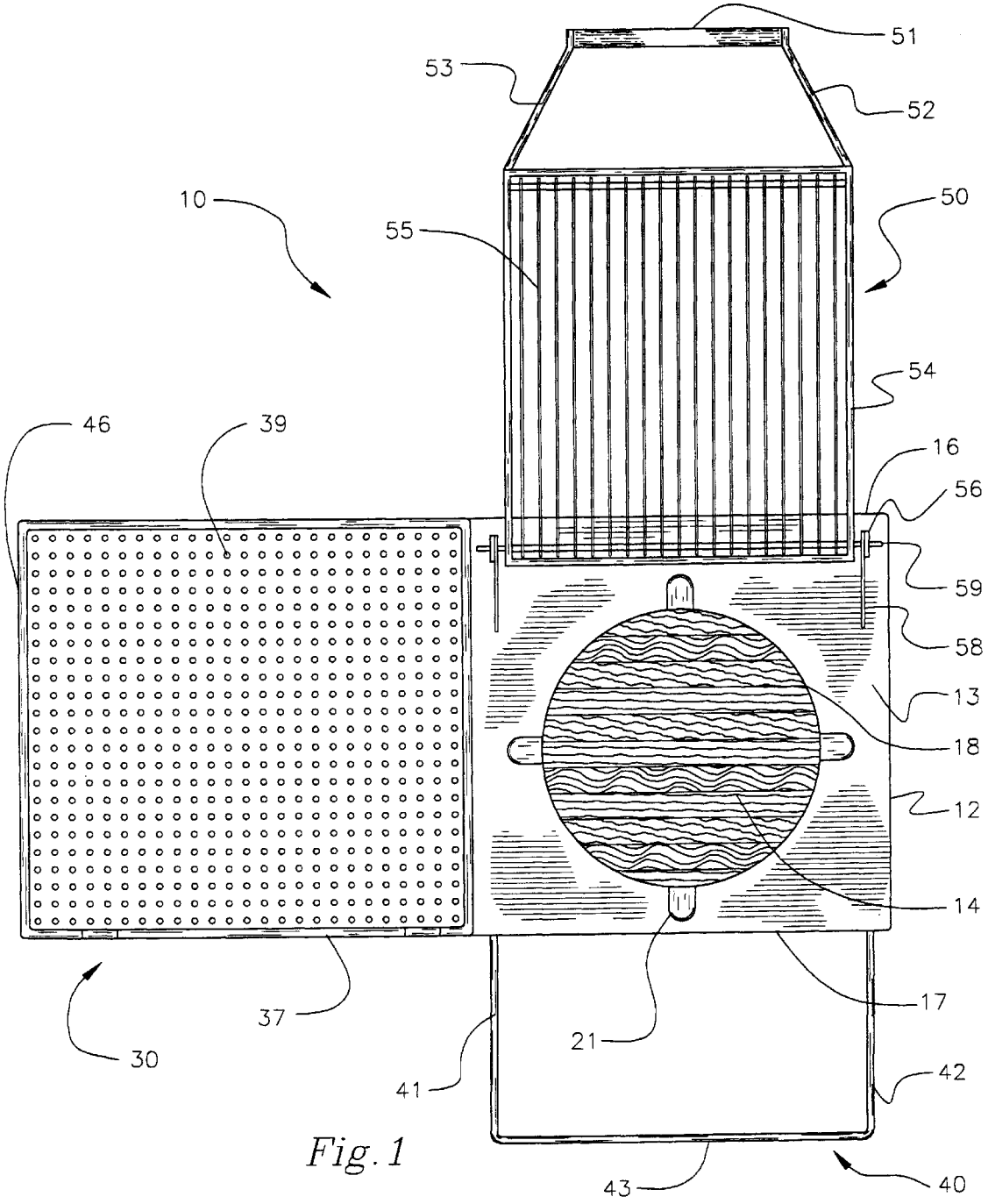
FIG. 1 is a top plan view of a new vegetable cutting device according to the present invention.

With reference now to the drawings, and in particular to FIGS. 1 through 7 thereof, a new vegetable cutting device embodying the principles and concepts of the present invention and generally designated by the reference numeral 10 will be described.

More specifically, it will be noted that the vegetable cutting device 10 comprises a cutting board 12 having a cutting board top surface 13, a cutting board bottom surface 14 and an aperture (not shown) in a center thereof, a turntable 18 having a top surface 19 and a bottom surface 20, the bottom surface 20 further including a shaft 24 integrally formed perpendicular to a center thereof, the shaft 24 being receivable within the aperture, a cutting tool 50 mounted upon the cutting board top surface 13 and a basket 30 having a plurality of perforations 39 formed of a bottom shelf 29 thereof and hingedly attachable to the cutting board 12.

With reference to FIG. 1 there is shown the cutting board 12, preferably formed of a durable wood material, including the cutting board top surface 13 upon which the turntable 18, also formed of a durable wood material, is shown rotatably mounted. The turntable 18 has a top surface 19 upon which vegetables to be cut and chopped are placed. Additionally the turntable includes a side surface 22 upon which are disposed a plurality of knobs 21. A means for cutting including a cutting tool 50 formed of stainless steel is shown mounted upon the cutting board top surface 13 along an axis parallel to a cutting board first edge 16. The cutting tool 50 includes a rectangular frame 54 having a plurality of blades 55 fixedly attached therein. At one end of the frame 54 a pin 59 extends therethrough for releasable engagement to a means for mounting the cutting tool 50 to the cutting board 12. The cutting tool 50 further includes a handle 51 fixedly attached to a pair of brackets 52 and 53, the brackets 52 and 53 shown fixedly attached to the frame 54 (FIG. 5).

With continued reference to FIG. 1 there is shown a means for holding a disposal bag including a steel rod 40 having a lateral member 43 and two side members 41 and 42. The two side members 41 and 42 are slidably disposed within a pair of holes (not shown) formed in a cutting board third edge 17 opposite the cutting board first edge 16.

The basket 30, formed of plastic, is shown attached to the cutting board 12 and includes a plurality of perforations 39 formed at a bottom shelf 29 thereof, the bottom shelf 29 shown formed proximate a bottom portion 28 having a drain hole (not shown). A drain plug 27 is shown for stopping the drain hole.

A cutout 37, whose function will be further described hereinafter, is shown formed in a top portion 38 of a first side wall 36. A basket top surface 46 is shown having the same peripheral dimension as the cutting board 12.

Figure 2:
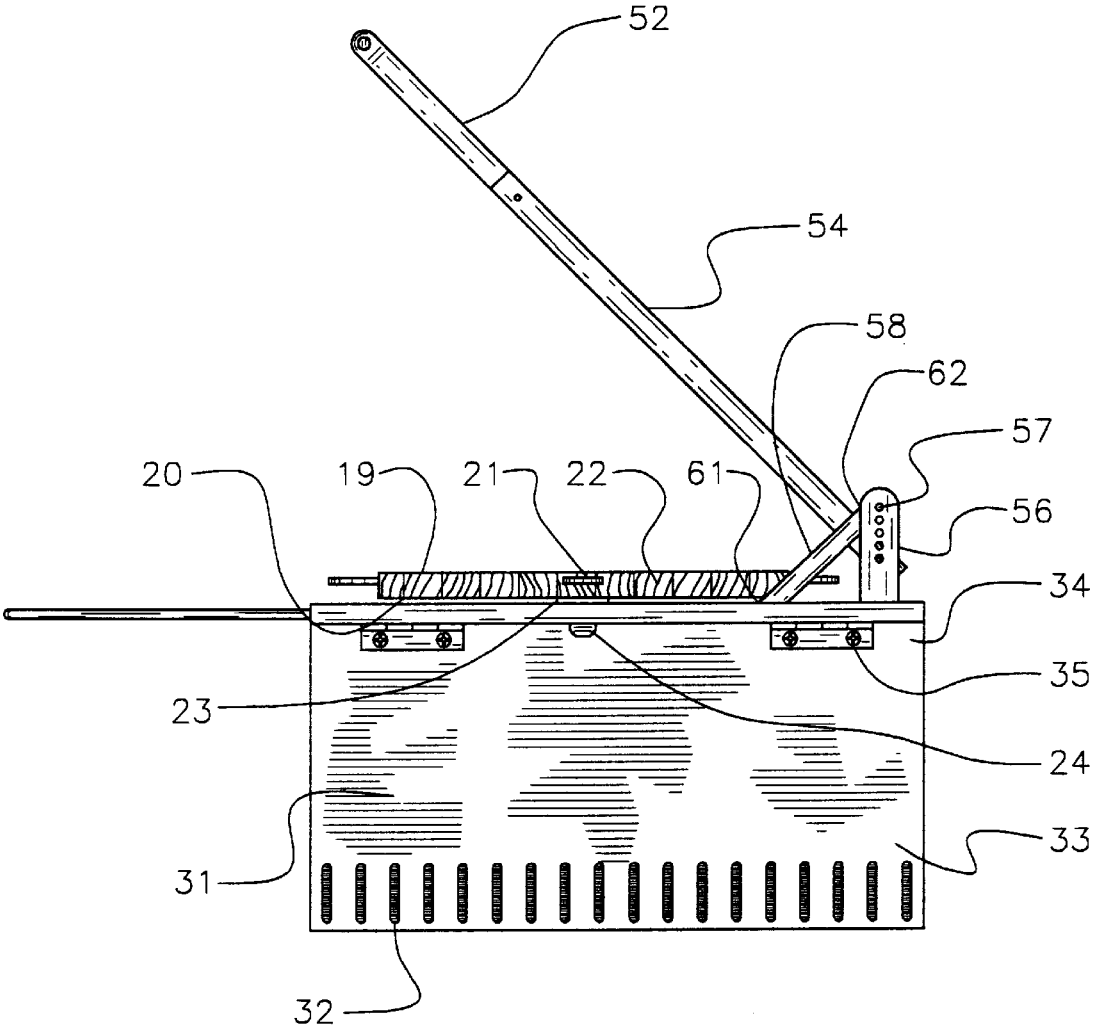
FIG. 2 is a right side elevation view thereof.

With reference to FIG. 2 there is shown the means for mounting the cutting tool 50 to the cutting board top surface 13. A pair of spaced brackets 56 are fixedly attached perpendicularly to the cutting board 12 as by gluing along an axis parallel to the cutting board first edge 16. A pair of support brackets 58 are fixedly attached to the cutting board 12 at a first end 61 thereof as by gluing and to the spaced brackets 36 at a second end 62 as by welding. A plurality of positioning apertures 57 are shown formed in the spaced brackets 58 for receiving the ends of the pin 59. The basket 30 is shown as having a sufficient depth to receive the cutting board 12 and the spaced brackets 56.

A spacer 23 is shown disposed between the cutting board top surface 13 and the turntable bottom surface 20. The spacer 23 is shown disposed about the shaft 24 and reduces the amount of friction between the cutting board top surface 13 and the turntable bottom surface 20.

Figure 3:
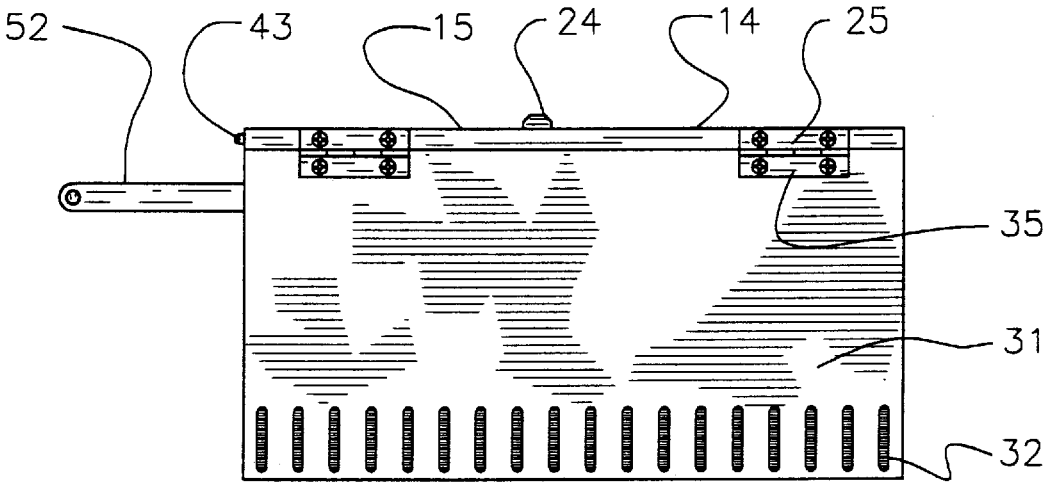
FIG. 3 is a right side elevation view of the invention showing the cutting board and cutting device disposed within the basket in a stored position.
Figure 4:
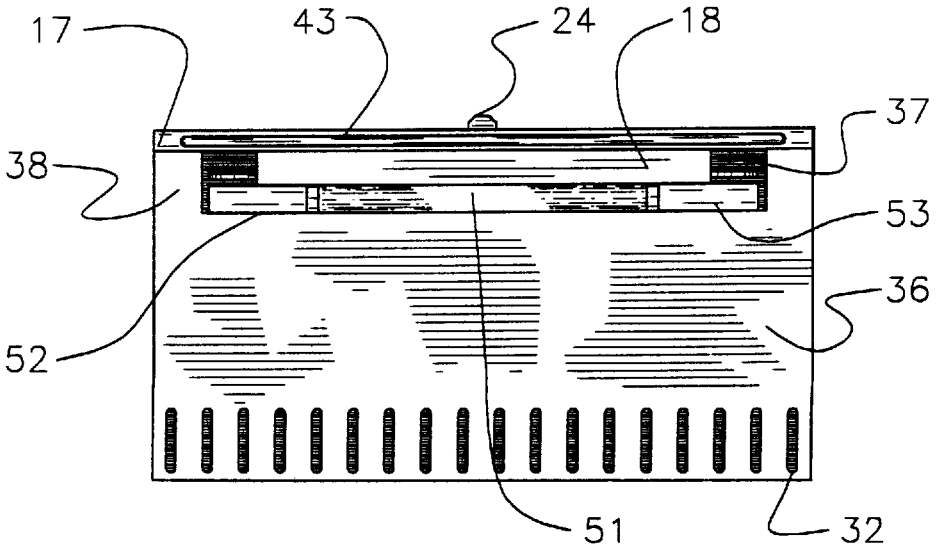
FIG. 4 is a front elevation view of the invention showing the cutting board and cutting device disposed within the basket in a stored position.

With reference to FIG. 3 there is shown the basket 30 hingedly attached to a cutting board second edge 15 by means of hinges 25 and 35. The cutting board second edge 15 is shown adjacent the cutting board first edge 16. The inventive device is shown in a stored position in which the cutting board 12 rests upon the basket top surface 46 and the handle brackets 52 and 53 and turntable 18 are received within the cut out 37 as shown more clearly in FIG. 4.

With reference to FIGS. 5 through 7, cutting tools 50, 65 and 66 are shown. Cutting tool 50 is shown as having the cutting blades 55 spaced ¼ inch apart. Cutting tools 65 and 66 have cutting blades (not shown) spaced ½ inch and ⅛ inch apart respectively.

In use, vegetables to be cut are placed upon the turntable 18. An appropriately sized cutting tool 50, 65 or 66 is positioned and mounted to the cutting board 12 by inserting the pin 59 into the appropriate positioning aperture 57. The cutting board 12 is placed upon a flat surface with the basket 30 positioned in hanging relation thereto. The vegetables are cut and chopped by grasping the handle 51 of the cutting tool 50 and applying a downward force about the pin 59 thereby causing the blades 55 to cut the vegetables. Chopping is achieved by rotating the turntable 18 by means of the knobs 21 disposed upon the turntable side surface 22. Any part of the vegetable not desired to be used can be easily disposed into a disposal bag hung over the rod 40. Once the vegetables have been cut and chopped to the desired size, they are placed in the basket 30 and soaked and/or washed.

The Vegetable Cutter 10 of the present invention is easily cleaned and stored by washing the cutting board 12, turntable 18 (which can be easily removed from the cutting board 12), cutting tool 50 and basket 30. To store the device, the cutting tool 50 is rotated to a position over the turntable 18. The cutting board 12 is then rotated about the hinges 25 and 35 and rests upon the basket top surface 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A vegetable cutting device comprising:

a cutting board having a cutting board top surface, a cutting board bottom surface, and an aperture in a center thereof;

a turntable having a top surface and a bottom surface, the bottom surface further comprising a shaft integrally formed perpendicular to a center thereof, the shaft receivable within the aperture;

a means for cutting;

a means for mounting the means for cutting upon the cutting board top surface; and a basket having a bottom portion and a bottom shelf disposed proximate the bottom portion, the bottom shelf having a plurality of perforations formed therethrough, the basket being hingedly attached to the cutting board, the turntable, the means for cutting and the means for mounting the means for cutting upon the cutting board top surface being receivable within an interior portion of the basket.

2. The vegetable cutting device of claim 1, wherein the means for cutting further comprise a frame having a plurality of blades fixedly attached therein, the frame further comprising a handle disposed at one end and a pin extending therethrough at the other end.

3. The vegetable cutting device of claim 2, wherein the means for mounting the means for cutting upon the cutting board top surface further comprise a pair of spaced brackets fixedly attached to the cutting board along an axis parallel to a cutting board first edge and extending perpendicularly from the cutting board top surface, a pair of support brackets fixedly attached to the cutting board at a first end thereof and to the spaced brackets at a second end thereof, and a plurality of positioning apertures formed in the spaced brackets for receiving the ends of the pin.

4. The vegetable cutting device of claim 3, wherein the basket is hingedly attachable to the cutting board along a cutting board second edge, the cutting board second edge being adjacent to the cutting board first edge, and wherein the basket has the same peripheral dimension as the cutting board and has a depth sufficient to receive the cutting board and the spaced brackets.

5. The vegetable cutting device of claim 4, wherein the basket further comprises a side wall having a cut out portion formed in a top portion thereof for receiving the handle.

* * * * *